US007991616B2

(12) United States Patent
Fujita et al.

(10) Patent No.: US 7,991,616 B2
(45) Date of Patent: Aug. 2, 2011

(54) SPEECH SYNTHESIZER

(75) Inventors: Yusuke Fujita, Kokubunji (JP); Ryota Kamoshida, Kodaira (JP); Kenji Nagamatsu, Fuchu (JP)

(73) Assignee: Hitachi, Ltd., Tokyo (JP)

( * ) Notice: Subject to any disclaimer, the term of this patent is extended or adjusted under 35 U.S.C. 154(b) by 953 days.

(21) Appl. No.: 11/976,179

(22) Filed: Oct. 22, 2007

(65) Prior Publication Data

US 2008/0243511 A1 Oct. 2, 2008

(30) Foreign Application Priority Data

Oct. 24, 2006 (JP) ..... 2006-288675

(51) Int. Cl.
*G10L 13/08* (2006.01)

(52) U.S. Cl. ..... 704/260; 704/258; 704/259; 704/256; 704/267; 434/116; 434/169; 345/473; 341/50

(58) Field of Classification Search ..... 704/258, 704/259, 260, 256, 267, 268, 211; 434/116, 434/169, 118; 345/473; 341/50
See application file for complete search history.

(56) References Cited

U.S. PATENT DOCUMENTS

| | | | | |
|---|---|---|---|---|
| 5,204,905 | A * | 4/1993 | Mitome | 704/260 |
| 5,682,502 | A * | 10/1997 | Ohtsuka et al. | 704/267 |
| 5,740,320 | A * | 4/1998 | Itoh | 704/267 |
| 5,751,907 | A * | 5/1998 | Moebius et al. | 704/267 |
| 5,864,820 | A * | 1/1999 | Case | 704/278 |
| 5,913,194 | A * | 6/1999 | Karaali et al. | 704/259 |
| 6,112,178 | A * | 8/2000 | Kaja | 704/267 |
| 6,226,614 | B1 * | 5/2001 | Mizuno et al. | 704/260 |
| 6,366,883 | B1 * | 4/2002 | Campbell et al. | 704/260 |
| 6,477,495 | B1 | 11/2002 | Nukaga et al. | |
| 6,665,641 | B1 * | 12/2003 | Coorman et al. | 704/260 |
| 7,603,278 | B2 * | 10/2009 | Fukada et al. | 704/260 |
| 7,668,718 | B2 * | 2/2010 | Kahn et al. | 704/270 |
| 7,765,103 | B2 * | 7/2010 | Yamazaki | 704/259 |
| 2002/0049594 | A1 * | 4/2002 | Moore et al. | 704/258 |
| 2003/0028376 | A1 * | 2/2003 | Meron | 704/258 |
| 2004/0111266 | A1 * | 6/2004 | Coorman et al. | 704/260 |
| 2005/0119889 | A1 * | 6/2005 | Yamazaki | 704/259 |
| 2007/0203702 | A1 * | 8/2007 | Hirose et al. | 704/256 |

FOREIGN PATENT DOCUMENTS

| | | |
|---|---|---|
| JP | 11-249677 | 3/1999 |
| JP | 2005-321520 | 5/2004 |

* cited by examiner

*Primary Examiner* — Vijay Chawan
(74) *Attorney, Agent, or Firm* — Stites & Harbison PLLC; Juan Carlos A. Marquez, Esq.

(57) ABSTRACT

The present invention is a speech synthesizer that generates speech data of text including a fixed part and a variable part, in combination with recorded speech and rule-based synthetic speech. The speech synthesizer is a high-quality one in which recorded speech and synthetic speech are concatenated with the discontinuity of timbres and prosodies not perceived. The speech synthesizer includes: a recorded speech database that previously stores recorded speech data including a recorded fixed part; a rule-based synthesizer that generates rule-based synthetic speech data including a variable part and at least part of the fixed part, from received text; a concatenation boundary calculator that a concatenation boundary position in a region in which the recorded speech data and the rule-based synthetic speech data overlap, based on acoustic characteristics of the recorded speech data and the rule-based synthetic speech data that correspond to the text; a concatenative synthesizer that generates synthetic speech data corresponding to the text by concatenating the recorded speech data and the rule-based synthetic speech data that are segmented in the concatenation boundary position.

12 Claims, 14 Drawing Sheets

401

RECORDED SPEECH DATA

402

INTERMEDIATE CODE shi/N/ju/ku/no/a/sh/ta/no/te/N/ki/de/s.

403

ACOUSTIC CHARACTERISTICS

| PHONEME LABEL | START TIME | END TIME | START FUNDAMENTAL FREQUENCY | END FUNDAMENTAL FREQUENCY |
|---|---|---|---|---|
| SH | 100ms | 210ms | 100Hz | 80Hz |
| I | 210ms | 280ms | 80Hz | 70Hz |
| NN | 280ms | 340ms | 70Hz | 110Hz |
| J | 340ms | 420ms | 110Hz | 150Hz |
| U | 420ms | 460ms | 150Hz | 140Hz |
| K | 460ms | 530ms | 140Hz | 120Hz |
| ... | ... | ... | ... | ... |

FIG.13

701 703 704

| SPEECH BLOCK CLASS CODE | DISPLAY INFORMATION | INTERMEDIATE CODE |
|---|---|---|
| 000 | FIXED SPEECH BLOCKS | |
| 100 | AT TRACK [ ] | ~/ba/N/se/N/ni |
| 200 | IS BOUND FOR [ ] | ~/yu/ki/ga/ma/i/ri/ma/s. |
| 300 | IS BOUND FOR [ ] | ~/yu/ki/de/s. |
| ... | ... | |

702

| SPEECH BLOCK CLASS CODE | DISPLAY INFORMATION | INTERMEDIATE CODE |
|---|---|---|
| 001 | THE TRAIN ARRIVING | ma/mo/na/ku |
| 101 | AT TRACK 1 | i/chi/ba/N/se/N/ni |
| 102 | AT TRACK 2 | ni/ba/N/se/N/ni |
| 201 | BOUND FOR SHINJUKU | shi/N/ju/ku/yu/ki/ga/ ma/i/ri/ma/s |
| 202 | BOUND FOR KOENJI | ko/o/e/N/ji/yu/ki/ga ma/i/ri/ma/s |
| 203 | BOUND FOR TOKYO | to/o/kyo/o/yu/ki/ga ma/i/ri/ma/s |
| ... | ... | |

SPEECH SYNTHESIZER

CLAIM OF PRIORITY

The present invention claims priority from Japanese application JP 2006-288675, filed on Oct. 24, 2006, the content of which is hereby incorporated by reference on to this application.

BACKGROUND OF THE INVENTION

The present invention relates to a device that synthesizes speech, and more particularly to a speech synthesizing technique for synthesizing speech data of text including a fixed part and a variable part in combination with recorded speech and rule-based synthetic speech.

Generally, recorded speech refers to speech created based on recorded speech, and rule-based synthetic speech refers to speech synthesized from characters or code strings representative of pronunciation. Rule-based synthesis of speech, after performing linguistic analysis for inputted text to generate intermediate code indicating information on phonemic transcription and prosodic transcription, determines prosody parameters such as a fundamental frequency pattern (oscillation period of vocal chord corresponding to the height of voice) and phoneme duration (length of each phoneme corresponding to speaking rate), and generates a speech waveform matched to the prosody parameters by waveform generation processing. As a method of generating a speech waveform from the prosody parameters, a concatenative speech synthesizer is widely used that combines speech units corresponding to phonemes and syllables.

The flow of general rule-based synthesis is as follows. In linguistic analysis, from inputted text, phonemic transcription information representative of a row of phonemes (minimum unit for distinguishing the meaning of speech) and syllables (a kind of collection of the soundings of speech including the coupling of about one to three phonemes), and prosodic transcription information representative of prosodic transcription (information that specifies the strength of pronunciation) and intonation (information indicating interrogative and speaker's feelings) are generated as intermediate code. To generate the intermediate code, linguistic analysis by use of a dictionary, and morphological analysis are applied. Next, to conform to prosodic transcription information of the intermediate code, prosody parameters such as fundamental frequency patterns and phoneme duration are determined. The prosody parameters are generated based on a prosody model studied by previously using real voice and heuristics (control rule heuristically determined). Finally, a speech waveform matched to the prosody parameters is generated by waveform generation processing.

Since the rule-based synthesis can output any inputted text as speech, a more flexible speech guidance system can be built in comparison with a case where recorded speech is used. However, since the quality of rule-based synthetic speech is poorer than that of real voice, conventionally, there has been a problem in terms of quality when rule-based synthetic speech is introduced in a speech guidance system such as an on-vehicle car navigation system that uses recorded speech.

Accordingly, to realize a speech guidance system that uses rule-based synthetic speech, by using previously recorded speech for a fixed part and rule-based synthetic speech for a variable part, a method of combining the high quality of recorded speech and the flexibility of rule-based synthetic speech is used.

However, speech outputted in combination with recorded speech and rule-based synthetic speech has had a problem in that the discontinuity of timbres and prosodies between the recorded speech and the rule-based synthetic speech is perceived, so that parts of recorded speech have high quality but the whole is poor in quality.

As a method of eliminating the discontinuity of prosodies, a method is disclosed that uses characteristics of recorded speech to set parameters for rule-based synthetic speech (e.g., Japanese Patent Application Laid-Open No. 11-249677). A method is disclosed that enlarges parts of rule-based synthetic speech, taking the continuity of prosodies of a fixed part and a variable part into account (e.g., Japanese Patent Application Laid-Open No. 2005-321520).

SUMMARY OF THE INVENTION

The related art has a problem in that while the prosody of parts of rule-based synthetic speech is natural, the difference of timbre between rule-based synthetic speech and recorded speech may become large, so that natural speech cannot be obtained as a whole.

The present invention solves the above-described problem, and its object is to provide a speech synthesizer of high quality in which the discontinuity of prosodies is not perceived when recorded speech and synthetic speech are concatenated.

To achieve the above-described object, the present invention is a speech synthesizer that synthesizes text including a fixed part and a variable part. The speech synthesizer includes: a recorded speech database that previously stores first speech data (recorded speech data) being speech data including the fixed part, generated based on recorded speech; a rule-based synthesizer that generates second speech data (rule-based synthetic speech data) including the variable part and at least part of the fixed part from the received text; a concatenation boundary calculator that selects the position of a concatenation boundary between the recorded speech data and speech data generated by rule-based synthesis, based on acoustic characteristics of a region in which the first speech data and the second speech data that correspond to the text overlap; and a concatenative synthesizer that synthesizes speech data of the text by concatenating third speech data produced by separating the first speech data in the concatenation boundary, and fourth speech data segmented by separating the second speech data in the concatenation boundary. Here, as an example, the fixed part can be defined as a part having a part corresponding to speech data, and the variable part can be defined as a part not having a part corresponding to speech data.

In this construction, by generating rule-based synthetic speech data so as to include part of a fixed part in addition to a variable part and producing an overlap region between the rule-based synthetic speech data and recorded speech data, a concatenation position between recorded speech and rule-based synthetic speech can be made variable. By using acoustic characteristics of the recorded speech and the rule-based synthetic speech in the overlap region to calculate an optimum concatenation position, natural synthetic speech is created compared with the related art.

In another construction of the present invention, a rule-based synthesizer is provided that uses the acoustic characteristics of the recorded speech data in the overlap region to generate rule-based synthetic speech data matching the recorded speech data.

In this construction, the discontinuity of prosodies can be eliminated by matching prosodies in the overlap region, and furthermore rule-based synthetic speech data of a preceding or following variable part in the overlap region can also be matched at the same time, so that synthetic speech matched not only in the concatenation boundary but also as a whole is created.

In another construction of the present invention, the rule-based synthesizer is provided that processes rule-based synthetic speech data, based on acoustic characteristics of recorded speech data and rule-based synthetic speech data in a concatenation boundary position obtained from the concatenation boundary calculator.

In this construction, after determining a concatenation boundary, by processing the characteristics of the rule-based synthetic speech data so that the acoustic characteristics in the vicinity of the concatenation boundary are brought closer to recorded speech, synthetic speech with the discontinuity of prosodies and timbres more inconspicuous is created.

By using phoneme class as acoustic characteristics in the present invention, a preferred concatenation boundary can be obtained. The phoneme class, for example, is information that stipulates the classification of phonemes such as voiced sound, unvoiced sound, plosive, and fricative. Although it goes without saying that concatenation distortion becomes inconspicuous by making concatenation in a pause (silence) region, concatenation distortion is inconspicuous also in the start of unvoiced plosive, where a short silence region exists. Since concatenation in a voiced region may make noise conspicuous because of the difference between fundamental frequencies and the difference between phases around concatenation boundary, concatenation in an unvoiced region is desirable. By using power as acoustic characteristics, concatenation distortion can be made inconspicuous by selecting concatenation boundary of low power.

By using fundamental frequencies as acoustic characteristics, a concatenation boundary in which prosodies are smoothly concatenated can be obtained. By selecting a phoneme boundary in which a difference between the fundamental frequencies of recorded speech and rule-based synthetic speech is small, the discontinuity of the fundamental frequencies becomes difficult to perceive. Use of phonemic duration makes it possible to select a concatenation boundary around which speaking rates do not change suddenly.

Using spectrums (information indicating frequency components of speech) as acoustic characteristics makes it possible to avoid a sudden change in timbre in the vicinity of concatenation boundary. Particularly, this is effective for a construction in which, after a concatenation boundary is determined, the characteristics of rule-based synthetic speech data are processed by using acoustic characteristics in the vicinity of concatenation boundary; the spectrum of rule-based synthetic speech in the vicinity of concatenation boundary can be brought closer to that of recorded speech.

In the present invention, the range of generating rule-based synthetic speech data includes part of a fixed part in addition to a variable part. It is desirable to define the range in any of one breath group (one unit split by pause for rest), one sentence (one unit split by punctuation), and the whole of a fixed part. Particularly, to match the prosodies of recorded speech and rule-based synthetic speech, it is desirable that the overlap region is large. However, when a method matching prosodies by other means can be used, or when there is a problem in terms of calculation amounts, the range may be defined in less than one breath group.

Although, in the concatenation boundary calculator of the present invention, candidate positions for concatenation boundary are all sample points in the overlap region, when a concatenation boundary is selected with restriction to phoneme boundaries, an effective concatenation boundary is obtained. By such a construction, acoustic characteristics of recorded speech and rule-based synthetic speech may be calculated only in phoneme boundaries, so that the construction is advantageous in terms of storage capacity and calculation amounts.

In the recorded speech database of the present invention, by storing speech data previously recorded in the unit of one breath group or one sentence including a fixed part and part of other than the fixed part, regions other than the fixed part in the recorded speech can also be effectively utilized. When text of a fixed part is previously set, determining recorded speech according to text of a variable part would make it possible to include part of the variable part as the overlap region when recorded speech can be used also for part of the variable part. This method allows most parts of recorded speech to be utilized, enabling the generation of synthetic speech of higher quality.

Furthermore, the speech synthesizer of the present invention, which synthesizes text including a fixed part and a variable part, includes: a recorded speech database that previously stores recorded speech data including the recorded fixed part; a rule-based synthesizer that generates rule-based synthetic speech data including the variable part and at least part of the fixed part from the received text; a concatenation boundary calculator that calculates a concatenation boundary position in a region in which the recorded speech data and the rule-based synthetic speech data overlap, based on acoustic characteristics of the recorded speech data and the rule-based synthetic speech data that correspond to the text; and a concatenative synthesizer that concatenates the recorded speech data and the rule-based synthetic speech data that are segmented in the concatenation boundary position, to generate synthetic speech data corresponding to the text.

Still furthermore, the speech synthesizer of the present invention, which synthesizes text including a fixed part and a variable part, includes: a recorded speech database that previously stores recorded speech data including the recorded fixed part; a rule-based synthetic parameter calculator that calculates rule-based synthetic parameters including the variable part and at least part of the fixed part from the received text, and generates acoustic characteristics of rule-based synthetic speech; a concatenation boundary calculator that calculates a concatenation boundary position in a region in which the recorded speech data and the rule-based synthetic parameters overlap, based on acoustic characteristics of the recorded speech and acoustic characteristics of the rule-based synthetic speech; a rule-based speech data synthesizer that generates rule-based synthetic speech data by using acoustic characteristics of the recorded speech, acoustic characteristics of the rule-based synthetic speech, and the concatenation boundary position; a concatenative synthesizer that concatenates the recorded speech data and the rule-based synthetic speech data that are segmented in the concatenation boundary position, and outputs synthetic speech data corresponding to the text; and a means that outputs the synthetic speech data.

Still furthermore, the speech synthesizer of the present invention, which creates synthetic speech by concatenating a speech block including a variable part and a speech block including a fixed part, previously recorded, includes: a recorded speech database that stores speech data including the speech blocks previously recorded; an input parser that generates intermediate code of a speech block of the variable part, and intermediate code of a speech block of the fixed part, from received input text; a recorded speech selector that selects appropriate recorded speech data from among plural recorded speech data having the same fixed part according to the input of the variable part; a rule-based synthesizer that uses intermediate code of a speech block of the variable part obtained by the input parser, and intermediate code of a speech block of the fixed part that are obtained in the input parser to determine the range of generating rule-based synthetic speech data; a concatenation boundary calculator that calculates a concatenation boundary position in a region in which the recorded speech data and the rule-based synthetic speech data overlap, using acoustic characteristics of the recorded speech data and acoustic characteristics of the rule-based synthetic speech data; a concatenative synthesizer that uses the concatenation boundary position obtained from the concatenation boundary calculator to cut off the recorded speech data and the rule-based synthetic speech data, and generates synthetic speech data corresponding to a speech block including the variable part by concatenating the recorded speech data and the rule-based synthetic speech data that are cut off; and a speech block concatenator that concatenates speech blocks, based on the order of speech blocks obtained from the input text, and creates output speech.

A speech synthesizing method of the present invention includes: a first step of previously storing recorded speech data and first intermediate code corresponding to the recorded speech data to prepare for input text; a second step of converting the input text into second intermediate code; a third step of referring to the first intermediate code to distinguish the second intermediate code into a fixed part corresponding to the first intermediate code and a variable part not corresponding to it; a fourth step of acquiring a part of the first intermediate code that corresponds to the fixed part, from the recorded speech data; a fifth step of using the second intermediate code to generate rule-based synthetic speech data of the whole of a part corresponding to the variable part and at least part of a part corresponding to the fixed part; and a sixth step of concatenating the acquired part of the recorded speech data and part of the generated rule-based synthetic speech data.

The acquired recorded speech data and the generated rule-based synthetic speech data can be used as one continuous phrase, respectively. Since two phrases have overlap locations, the freedom of concatenation locations is great, and they can be coupled by natural concatenation. That is, since the two pieces of speech data have an overlap region in a fixed part, a part in which the two pieces of speech data match in the region is selected as a concatenation boundary, where they may be concatenated. A criterion for evaluation of an optimum matching location is, for example, to select a location where a difference between characteristic quantities such as fundamental frequencies, spectrums, and durations of the two pieces of speech data is small. If necessary, one of the two pieces of data may be modified (processed) for concatenation. For example, parameters for generating rule-based synthetic speech data may be modified to match acoustic characteristics so that a difference between characteristic quantities of the recorded speech data and the rule-based synthetic speech data is small.

According to the present invention, a high-quality speech synthesizer can be realized in which the discontinuity of timbres and prosodies is not perceived when recorded speech and synthetic speech are concatenated.

BRIEF DESCRIPTION OF THE DRAWINGS

These and other features, objects and advantages of the present invention will become more apparent from the following description when taken in conjunction with the accompanying drawings wherein:

FIG. 13 is a drawing showing a concrete example of information stored in a speech block information storage unit in the third embodiment.

DETAILED DESCRIPTION OF THE PREFERRED EMBODIMENTS

Hereinafter, preferred embodiments of the present invention will be described in detail with reference to the accompanying drawings.

First Embodiment

Figure 1:
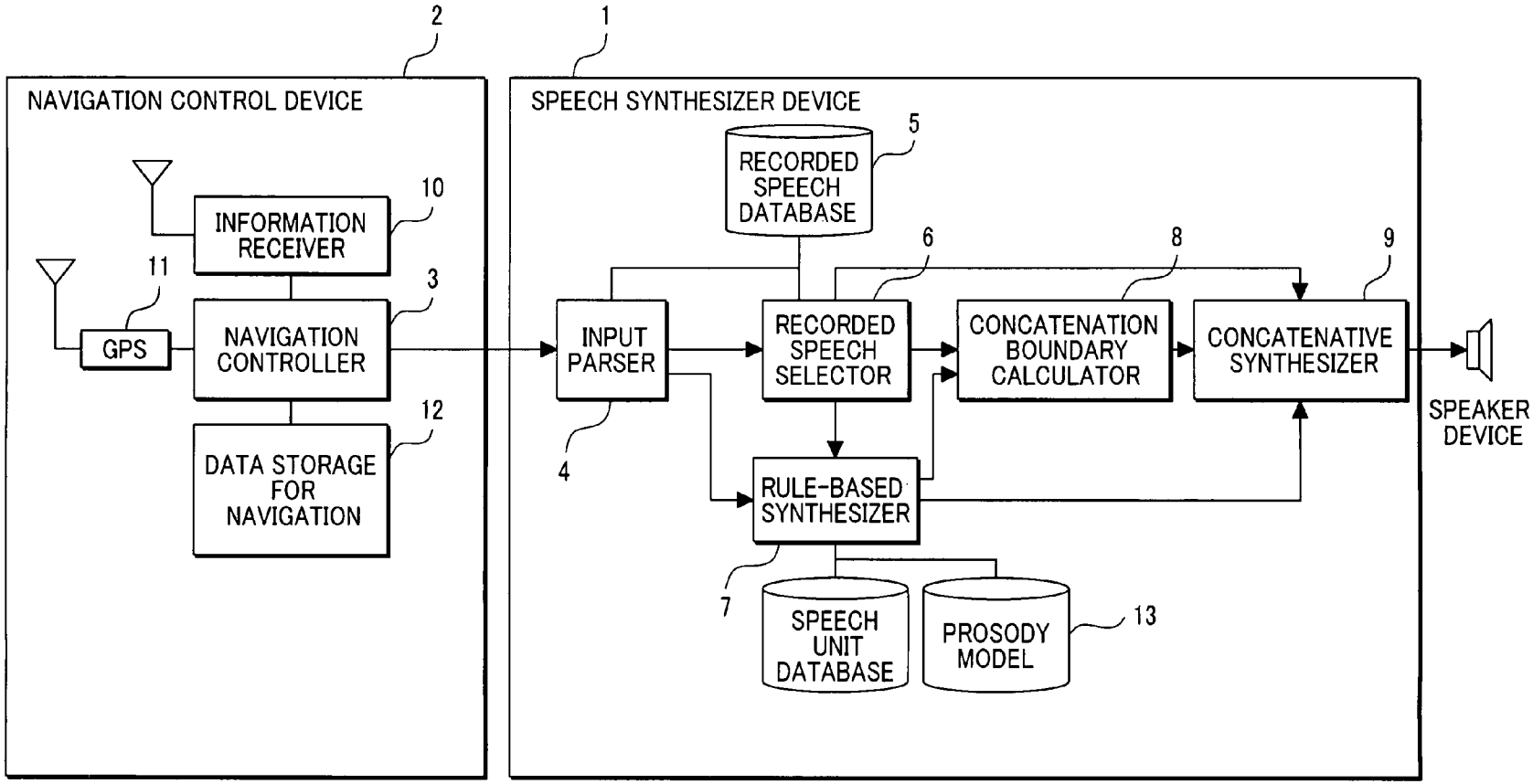
FIG. 1 is a block diagram showing the construction of a speech synthesizer in a first embodiment of the present invention.

FIG. 1 relates to a first embodiment of the present invention, and is a block diagram showing a speech synthesizer of the present invention constructed for the car navigation system.

This embodiment, as shown in the drawing, includes a speech synthesizer 1 and a navigation control device 2. The speech synthesizer 1 of the present invention includes: an input parser 4 that analyzes text input from a navigation controller 3; a recorded speech selector 6 that generates recorded speech data from a recorded speech database 5 by using intermediate code of a fixed part obtained by the input parser 4; a rule-based synthesizer 7 that generates rule-based synthetic speech data by using parts of intermediate code of a variable part and intermediate code of a fixed part that are obtained by the input parser 4 and acoustic characteristics of recorded speech obtained by the recorded speech selector 6; a concatenation boundary calculator 8 that calculates a concatenation boundary between recorded speech data and rule-based synthetic speech data by using acoustic characteristics of recorded speech obtained by the recorded speech selector 6 and acoustic characteristics of rule-based synthetic speech obtained by the rule-based synthesizer 7; and a concatenative synthesizer 9 that segments recorded speech data and rule-based synthetic speech data by using concatenation boundary obtained by a concatenation boundary calculator and concatenates the segmented data.

Figure 2:
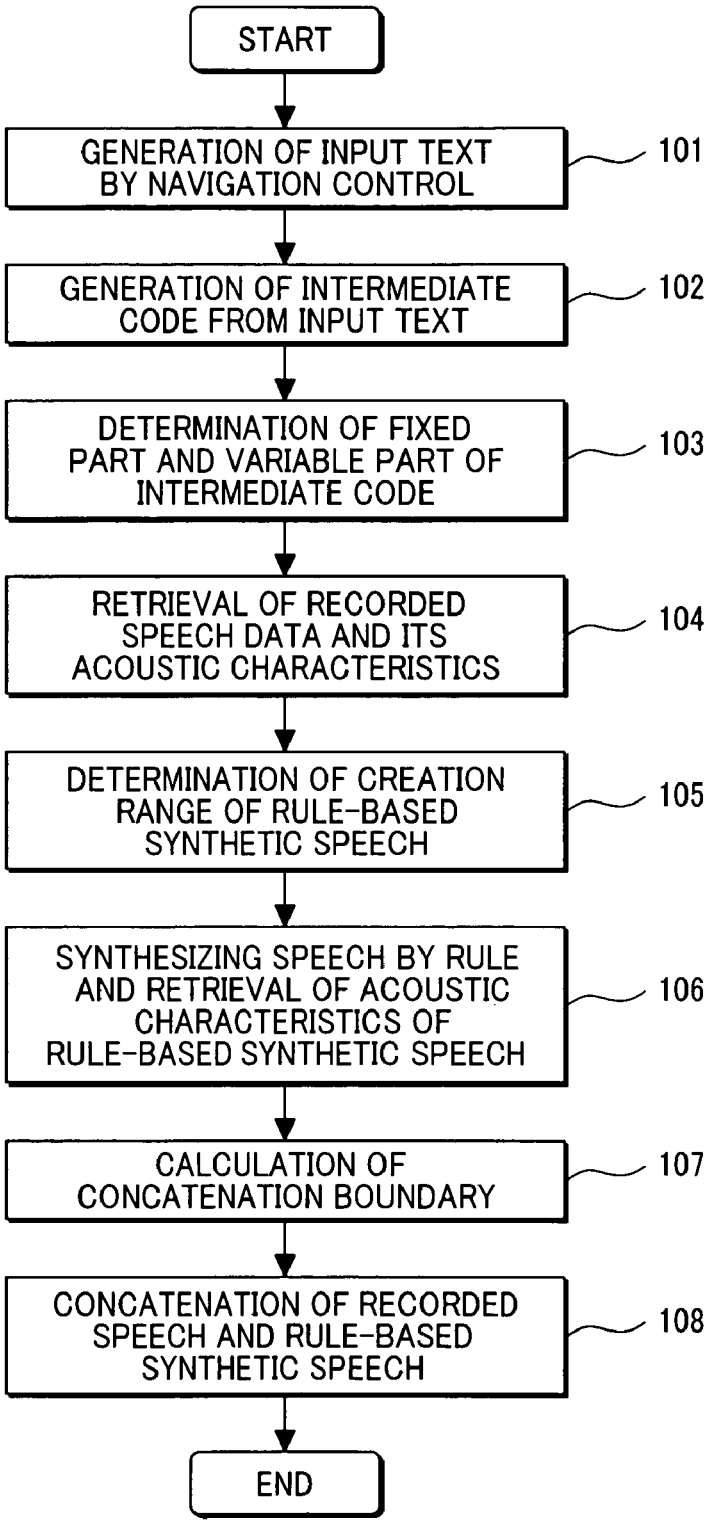
FIG. 2 is a flowchart showing the operation of the speech synthesizer in the first embodiment.

Referring to FIGS. 1 and 2, the following describes the operation of the speech synthesizer 1 of the first embodiment of the present invention. FIG. 2 is a flowchart showing the operation of the speech synthesizer of the first embodiment.

The navigation control device 2 determines input text to be passed to the speech synthesizer 1.

The navigation controller 3 receives various information such as weather forecast and traffic information from an information receiver 10, and generates input text to be passed to the speech synthesizer 1 by combining current position information obtained from GPS 11 and map information of a data storage for navigation 12 (Step 101).

Next, the input parser 4 receives input text for speech output from the navigation control device 2, and converts it into intermediate code (Step 102). Input text is a character string including a mixture of Chinese characters and Japanese characters such as "Kokubunji no ashita no tenki desu". The input parser 4 performs linguistic analysis, and converts the input text into intermediate code for speech synthesis such as "ko/ku/bu/N/ji/no/a/sh/ta/no/te/N/ki/de/s."

Figure 3:
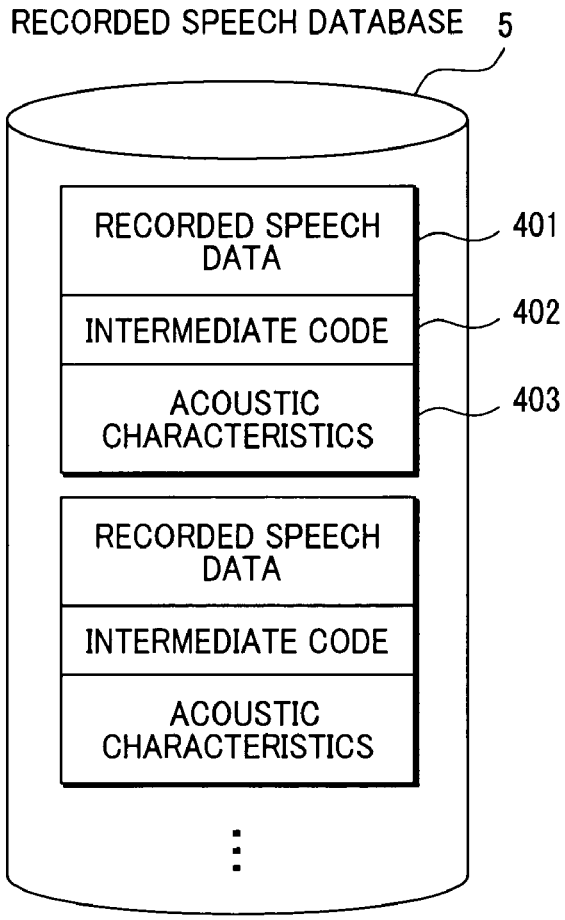
FIG. 3 is a drawing showing information stored in a recorded speech database in the first embodiment.

Next, the input parser 4 refers to recorded speech data 401 and intermediate code 402 stored in association with it, as shown in FIG. 3, in the recorded speech database 5, to search for a matching part, determines intermediate code to be used as a fixed part, and determines a part that cannot be associated with speech waveform data 401, as a variable part (Step 103).

Figure 4:
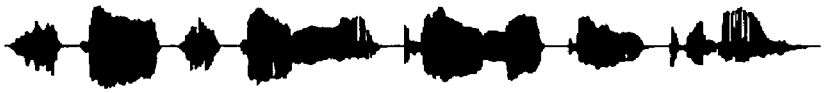
FIG. 4 is a drawing showing a concrete example of information stored in the recorded speech database in the first embodiment.

In the recorded speech database 5, as described above, in a structure as shown in FIG. 3, plural sets of intermediate code 402 associated with recorded speech data 401 are stored. The operation of Step 103 is described, assuming that intermediate code "shi/N/ju/ku/no/a/sh/ta/no/te/N/ki/de/s" is stored in the recorded speech database, as shown in FIG. 4.

The intermediate code "ko/ku/bu/N/ji/no/a/sh/ta/no/te/N/ki/de/s" obtained from the input parser 4 is successively compared with intermediate code 402 stored in the recorded speech database 5. Since "shi/N/ju/ku/no/a/sh/ta/no/te/N/ki/de/su" matches intermediate code obtained from the input parser 4 in a part of "no/a/sh/ta/no/te/N/ki/de/s," recorded speech data 401 can be used with the corresponding part as a fixed part. Accordingly, "no/a/sh/ta/no/te/N/ki/de/s" is determined as a fixed part, and "ko/ku/bu/N/ji" that cannot be associated with recorded speech data is determined as a variable part.

Next, the recorded speech selector 6 retrieves recorded speech data 401 and acoustic characteristics 403 of recorded speech (Step 104).

The recorded speech selector 6 uses the intermediate code of the fixed part obtained in the input parser 4 to retrieve recorded speech data 401 from the recorded speech database 5. Here, even when the intermediate code of the fixed part is "no/a/sh/ta/no/te/N/ki/de/s," recorded speech data of at least one of before and after the intermediate code is retrieved together. Here, as an example, the whole recorded speech data corresponding to "shi/N/ju/ku/no/a/sh/ta/no/te/N/ki/de/s" is retrieved. Segmenting only a part corresponding to the fixed part is not performed here.

The recorded speech selector 6 retrieves acoustic characteristics 403 stored in association with recorded speech data 401 in the recorded speech database 5. The acoustic characteristics are stored in a structure as shown in an example of FIG. 4. For each phoneme of recorded speech, phoneme class and start/end times and fundamental frequencies are described.

The rule-based synthesizer 7 uses the intermediate code of the variable part and the intermediate code of the fixed part that are obtained by the input parser 4, and determines a range of creating the rule-based synthetic speech (Step 105). When a range of creating rule-based synthetic speech is defined as one sentence including a variable part, the fixed part "no/a/sh/ta/no/te/N/ki/de/s" is included in addition to the variable part "ko/ku/bu/N/ji" to create rule-based synthetic speech.

Next, the rule-based synthesizer 7 refers to acoustic characteristics 403 of recorded speech to generate rule-based synthetic speech data (Step 106). Rule-based synthetic parameters such as fundamental frequency and phoneme duration time are calculated using prosody model 13 previously stored in the rule-based synthesizer 7. In this case, by modifying the rule-based synthetic parameters by referring to acoustic characteristics of recorded speech, rule-based synthetic speech data easy to concatenate with recorded speech can be generated.

Figure 5:
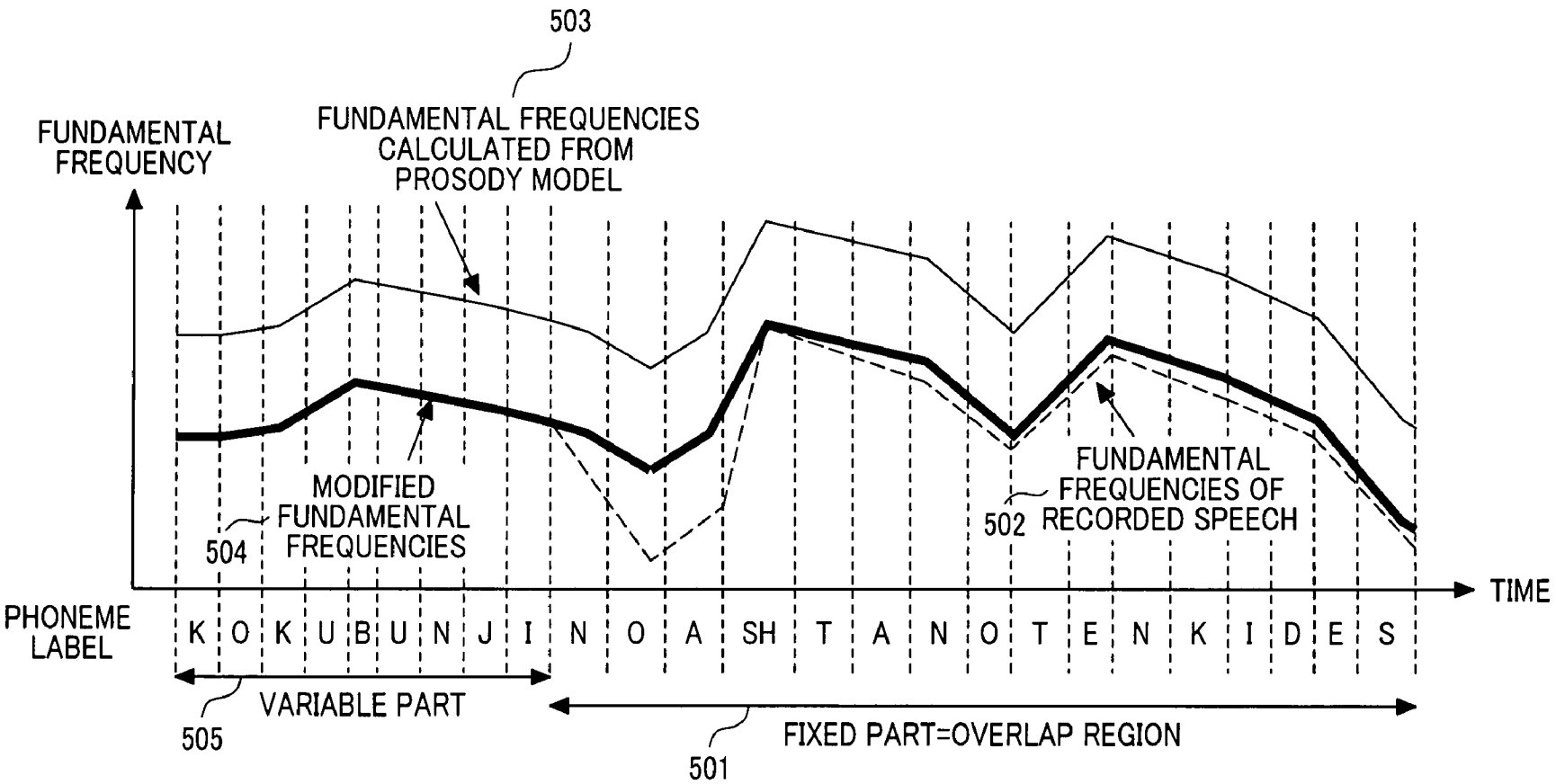
FIG. 5 is a drawing for explaining a method of generating rule-based synthetic speech in the first embodiment.

FIG. 5 shows the process of determining rule-based synthetic parameters by using fundamental frequency information of acoustic characteristics 403 of recorded speech. As shown in FIG. 5, in a region 501 in which recorded speech data and generated rule-based synthetic speech data overlap, a rule-based synthetic parameter 503 (fundamental frequency pattern set by prosody model) calculated from prosody model 13 is modified so that an error from acoustic characteristics (fundamental frequency pattern of recorded speech) 502 of recorded speech data become trivial, and acoustic characteristics (modified fundamental frequency pattern) 504 of rule-based synthetic speech data is generated. As modification methods, operations such as parallel movement, and enlargement and reduction of dynamic range are used.

In the region 501 in which recorded speech data and rule-based synthetic speech data overlap, an operation to match acoustic characteristics is performed, and the same operation is also performed for a variable part 505 not overlapping with the recorded speech data. Thereby, the prosodies of the variable part and the fixed part can be matched.

Acoustic characteristics are relieved of mismatch of the rhythms between recorded speech data and rule-based synthetic speech data by using phonemic duration in addition to fundamental frequencies. Spectrum information of recorded speech can be used as acoustic characteristics, so that discontinuity of recorded speech data and rule-based synthetic speech data can be eliminated in terms of timbre.

Figure 6:
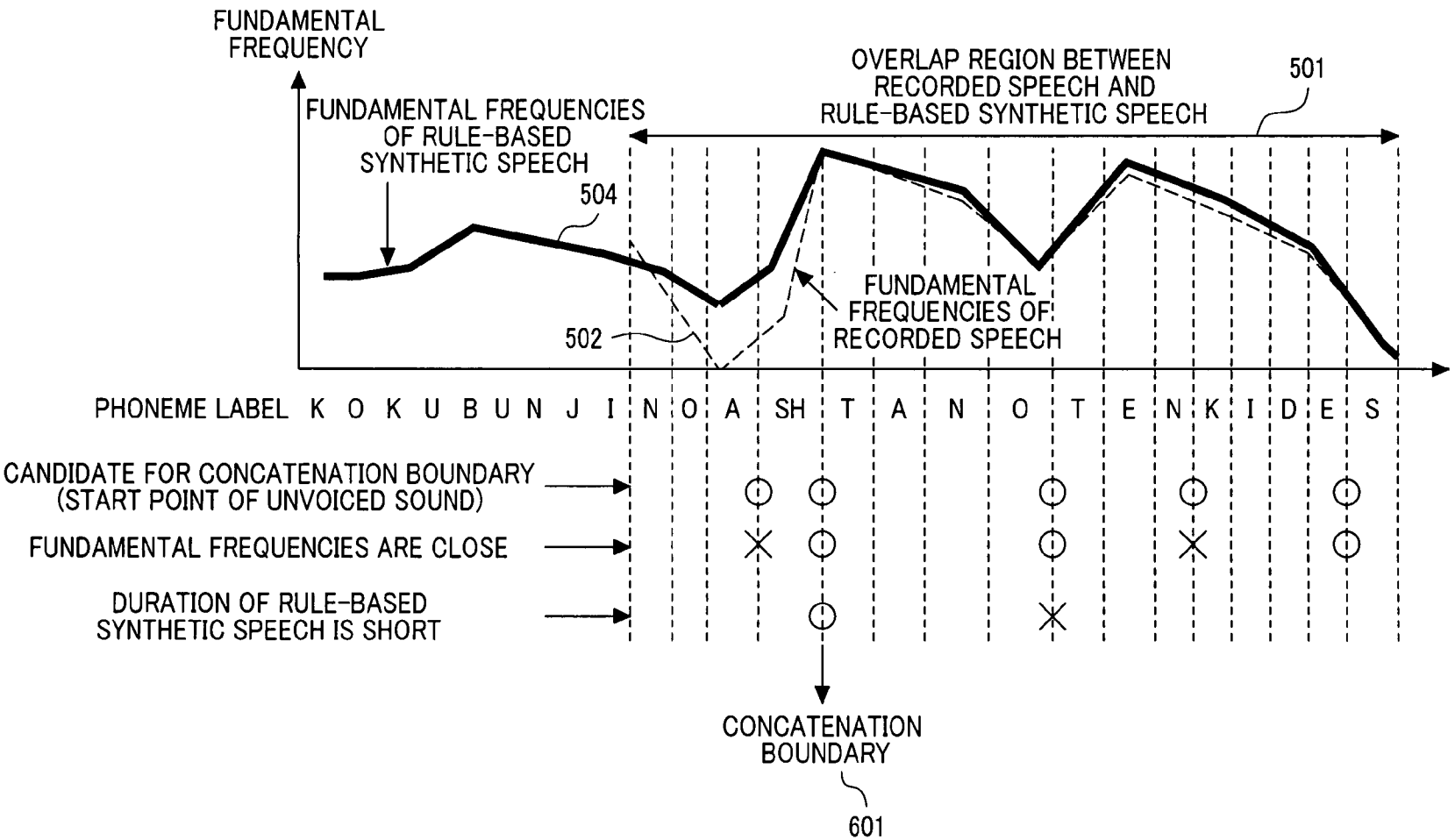
FIG. 6 is a drawing for explaining a method of selecting a concatenation boundary position in the first embodiment.

Next, the concatenation boundary calculator 8 uses the acoustic characteristics 502 of the recorded speech data and the acoustic characteristics 504 of the rule-based synthetic speech data to calculate a concatenation boundary position 601 shown in FIG. 6 in the overlap region 501 between the recorded speech data and the rule-based synthetic speech data (Step 107). When fundamental frequencies are afforded as acoustic characteristics in the overlap region 501 between the recorded speech data and the rule-based synthetic speech data, a calculation method is described using FIG. 6 as an example.

Phoneme class information is used to select an unvoiced sound region in speech such as the start of unvoiced plosive as a candidate of concatenation boundary. Then, differences of the fundamental frequencies of the recorded speech and the rule-based synthetic speech in phoneme boundary candidates are calculated, and a phoneme boundary candidate having a small difference is used as a candidate of concatenation boundary. At this point, when there are plural calculated comparable candidates, a concatenation boundary position 601 is determined to shorten the region of the rule-based synthetic speech data.

Although the start position of unvoiced plosive is effective to obtain a candidate of concatenation boundary by using phoneme class information, other unvoiced sounds also enable smoother concatenation than voiced sounds. However, when crossfade can be used for a concatenation method in the concatenative synthesizer 9, since smooth concatenation may be enabled even in voiced sounds, a method of selecting a candidate of concatenation boundary is not limited to the start position of unvoiced plosive.

As acoustic characteristics for calculating a concatenation position, besides using a difference between fundamental frequencies, by using a difference between phonemic durations, and a difference between spectrums together, a position for smoother concatenation can be calculated.

The concatenation boundary calculator 8, as in the above-described example, calculates a concatenation boundary by narrowing candidates by phoneme class information, then calculating a difference between fundamental frequencies. Alternatively, it can also calculate a concatenation boundary by defining a cost function as shown by Expression 1 below.

$$C(b)=Wp\times Cp(b)+Wf\times Cf(b)+Wd\times Cd(b)+Ws\times Cs(b)+WI\times CI(b) \quad \text{(Expression 1)}$$

A degree of difficulty in concatenation determined from the phoneme class information is defined as phoneme class cost Cp(b), and its weight is defined as Wp. Differences in acoustic characteristics are also defined as fundamental frequency cost Cf(b), phonemic duration cost Cd(b), and spectrum cost Cs(b), respectively, and their weights are defined as Wf, Wd, and Ws, respectively. Furthermore, from each phoneme boundary position, a difference between times in boundaries of fixed parts and variable parts is obtained, and defined as rule-based synthetic speech length cost CI(b), and its weight is defined as WI. Cost C(b) concerning a concatenation boundary position is calculated as the sum of weights of individual costs, and a phoneme boundary having the smallest cost can be designated as a concatenation boundary position.

Next, the concatenative synthesizer 9 uses the concatenation boundary position obtained from the concatenation boundary calculator 8 to cut off the recorded speech data and the rule-based synthetic speech data, and by concatenating the recorded speech data and rule-based synthetic speech data that are cut off, outputs synthetic speech data corresponding to the input text (Step 108). The concatenation boundary position is calculated as time in the recorded speech data and time in the rule-based synthetic speech data, and speech data is cut off and concatenated using the calculated times.

The concatenative synthesizer 9 can concatenate separated speech so that a concatenated portion is not conspicuous, by using crossfade processing. Particularly, when concatenation is made in the middle of a voiced part, noises during concatenation can be eliminated by performing crossfade processing one fundamental cycle of speech waveform in a concatenation boundary position synchronously with fundamental frequencies. However, since the crossfade processing may deteriorate signals, it is desirable to previously determine concatenation boundary positions to avoid concatenation in the middle of a voiced part.

Although, in the above-described embodiment, a description is made of the case where the range of generating rule-based synthetic speech data is defined as one sentence including a variable part, it may be generated every one breath group or every one sentence.

As has been described above, in the first embodiment, in a speech synthesizer, constructed for an on-vehicle car navigation system, that concatenates recorded speech data and rule-based synthetic speech data, natural synthetic speech can be generated by bringing the timbre and prosody of rule-based synthetic speech data close to recorded speech data, and calculating preferred concatenation boundaries.

Second Embodiment

The following describes a second embodiment of the present invention.

In the first embodiment, recorded speech data and rule-based synthetic speech data are concatenated using concatenation boundary positions determined after rule-based synthetic speech data is generated. However, rule-based synthetic speech data may be generated after concatenation boundary positions are determined.

Figure 7:
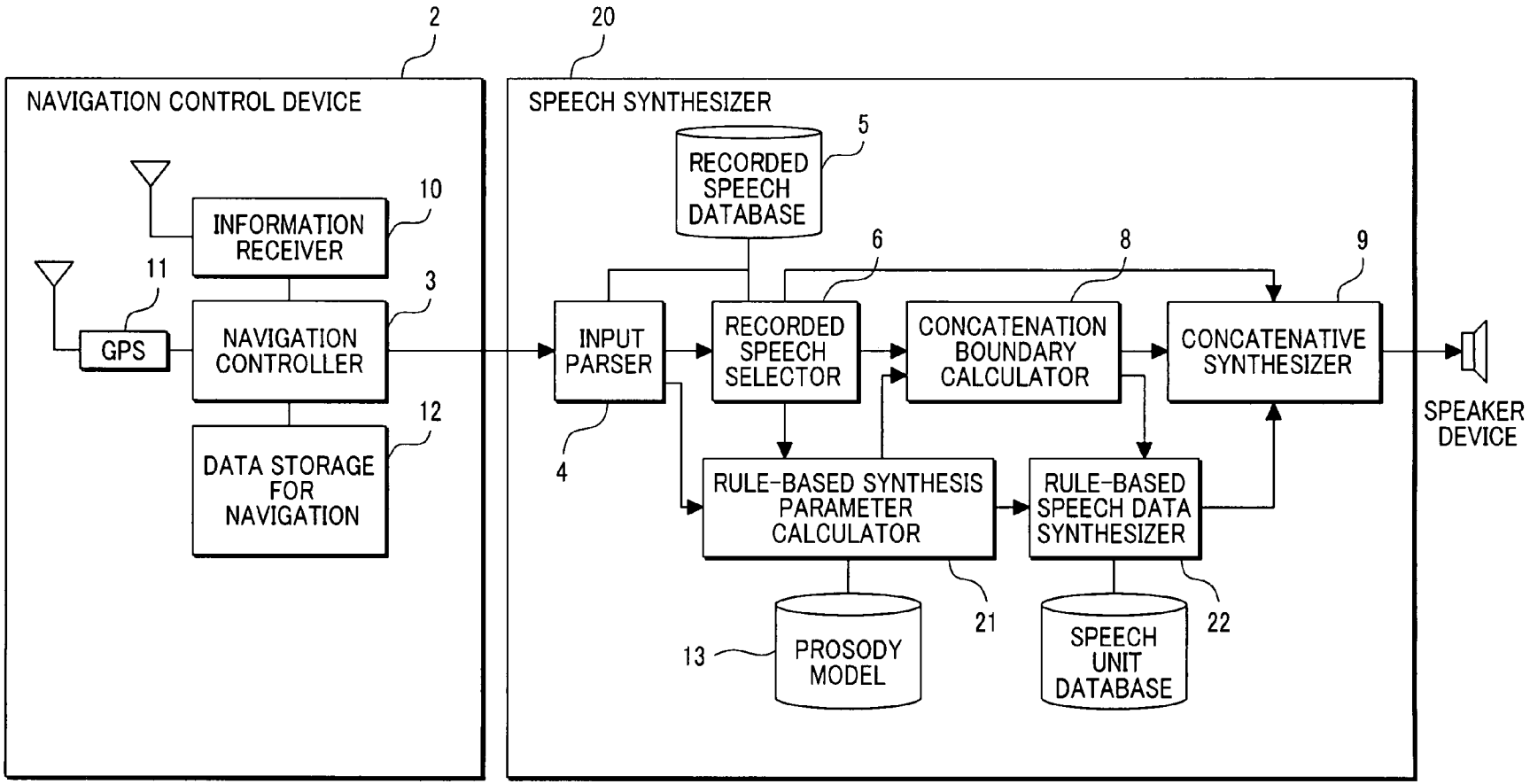
FIG. 7 is a block diagram showing the construction of the speech synthesizer in a second embodiment of the present invention.
Figure 8:
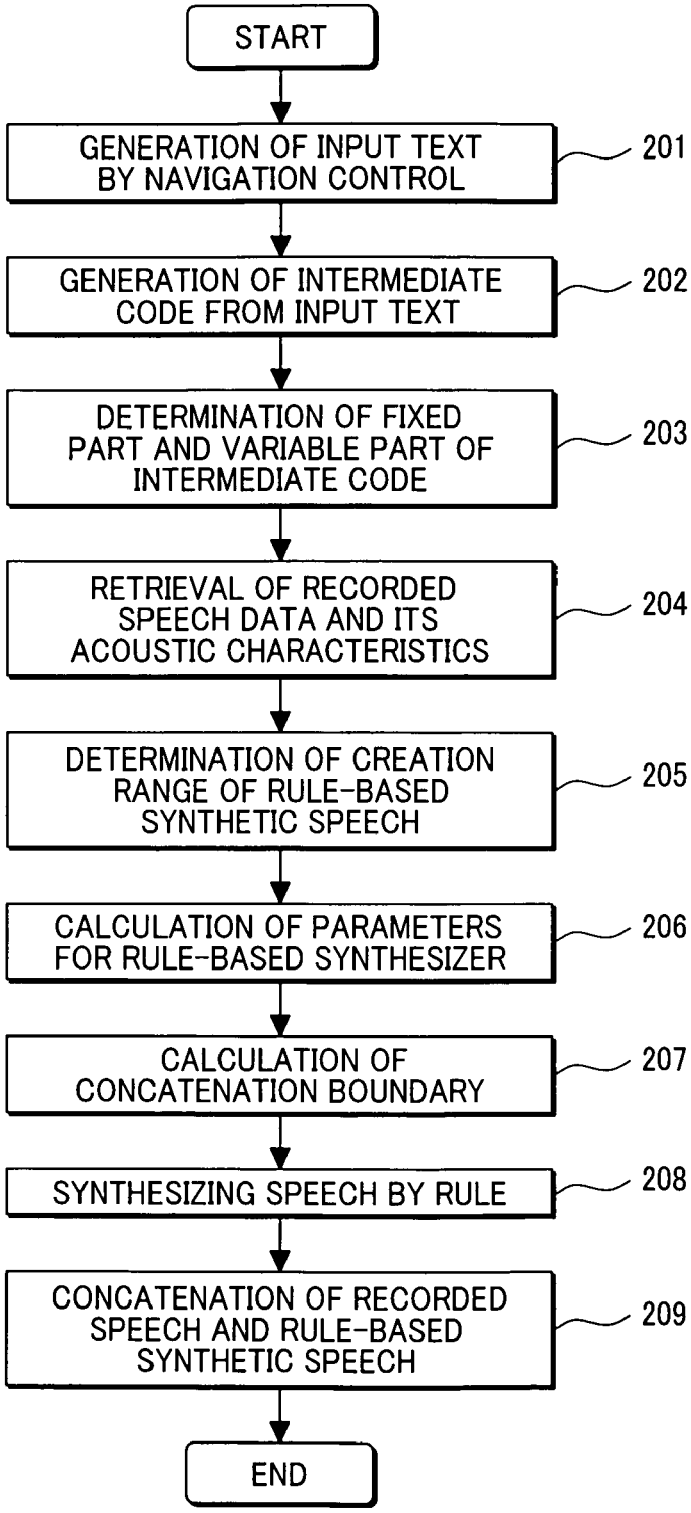
FIG. 8 is a flowchart showing the operation of the speech synthesizer in the second embodiment.

FIG. 7 is a block diagram showing a second embodiment of the present invention. In the second embodiment, instead of the rule-based synthesizer 7 in the first embodiment, a rule-based synthetic parameter calculator 21 and a rule-based speech data synthesizer 22 are provided. FIG. 8 is a flowchart showing the operation of a speech synthesizer 20 of the second embodiment. Referring to FIGS. 7 and 8, the operation of speech synthesizer 20 of the second embodiment is described.

The navigation controller 3 determines input text to be passed to the speech synthesizer 20 (Step 201).

Next, the input parser 4 determines intermediate code of a fixed part and intermediate code of a variable part (Steps 202 and 203). The recorded speech selector 6 retrieves recorded speech data and its acoustic characteristics (Step 204). Then, the range of creating of rule-based synthetic speech is determined (Step 205). Processing until this step is performed in the same way as in the first embodiment.

Next, a rule-based synthesis parameter calculator 21 calculates rule-based synthetic parameters, and generates acoustic characteristics of rule-based synthetic speech (Step 206). Although, in the first embodiment, the rule-based synthesizer 7 generates rule-based synthetic speech data, it does not generate the rule-based synthetic speech data in the second embodiment.

Next, the concatenation boundary calculator 8 uses the acoustic characteristics of the recorded speech and the acoustic characteristics of the rule-based synthetic speech to calculate a concatenation boundary position in the overlap region between the recorded speech data and the rule-based synthetic parameters (Step 207). This step is performed in the same way as in the first embodiment.

Next, the rule-based speech data synthesizer 22 uses the acoustic characteristics of the recorded speech, the acoustic characteristics of the rule-based synthetic speech, and the concatenation boundary position obtained in the concatenation boundary calculator 8 to generate rule-based synthetic speech data (Step 208). This step refers to acoustic characteristics of recorded speech in the concatenation boundary position, modifies the rule-based synthetic parameters obtained in Step 206, and generates rule-based synthetic speech data.

For example, for phonemes in the concatenation boundary position, by modifying the rule-based synthetic parameters so that a difference of acoustic characteristics become small, synthetic speech of less concatenation distortion is generated.

In the first embodiment, rule-based synthetic parameters are generated using acoustic characteristics in a region in which the range of rule-based synthetic speech data defined as one sentence including a variable part, and recorded speech data overlap. However, in the second embodiment, rule-based synthetic parameters are re-modified using acoustic characteristics of recorded speech in a concatenation boundary position obtained by the concatenation boundary calculator 8, and then rule-based synthetic speech data is generated. Thereby, smoother concatenation with a concatenation boundary position in mind is made.

Next, the concatenative synthesizer 9 uses the concatenation boundary position obtained from the concatenation boundary calculator 8 to cut off the recorded speech data and the rule-based synthetic speech data, and by concatenating the recorded speech data and rule-based synthetic speech data that are cut off, outputs synthetic speech data corresponding to the input text (Step 209).

As described above, in the second embodiment, unlike the first embodiment, the setting of rule-based synthetic parameters is performed in two steps. In a first step, rule-based synthetic parameters with smooth concatenation of the whole sentence in mind are set. In a second step, the concatenation boundary position obtained by the concatenation boundary calculator 8 is taken into account to modify the rule-based synthetic parameters. By thus modifying the rule-based synthetic parameters, more natural concatenation between recorded speech data and rule-based synthetic speech data is enabled.

Third Embodiment

The following describes a third embodiment of the present invention.

Figure 9:
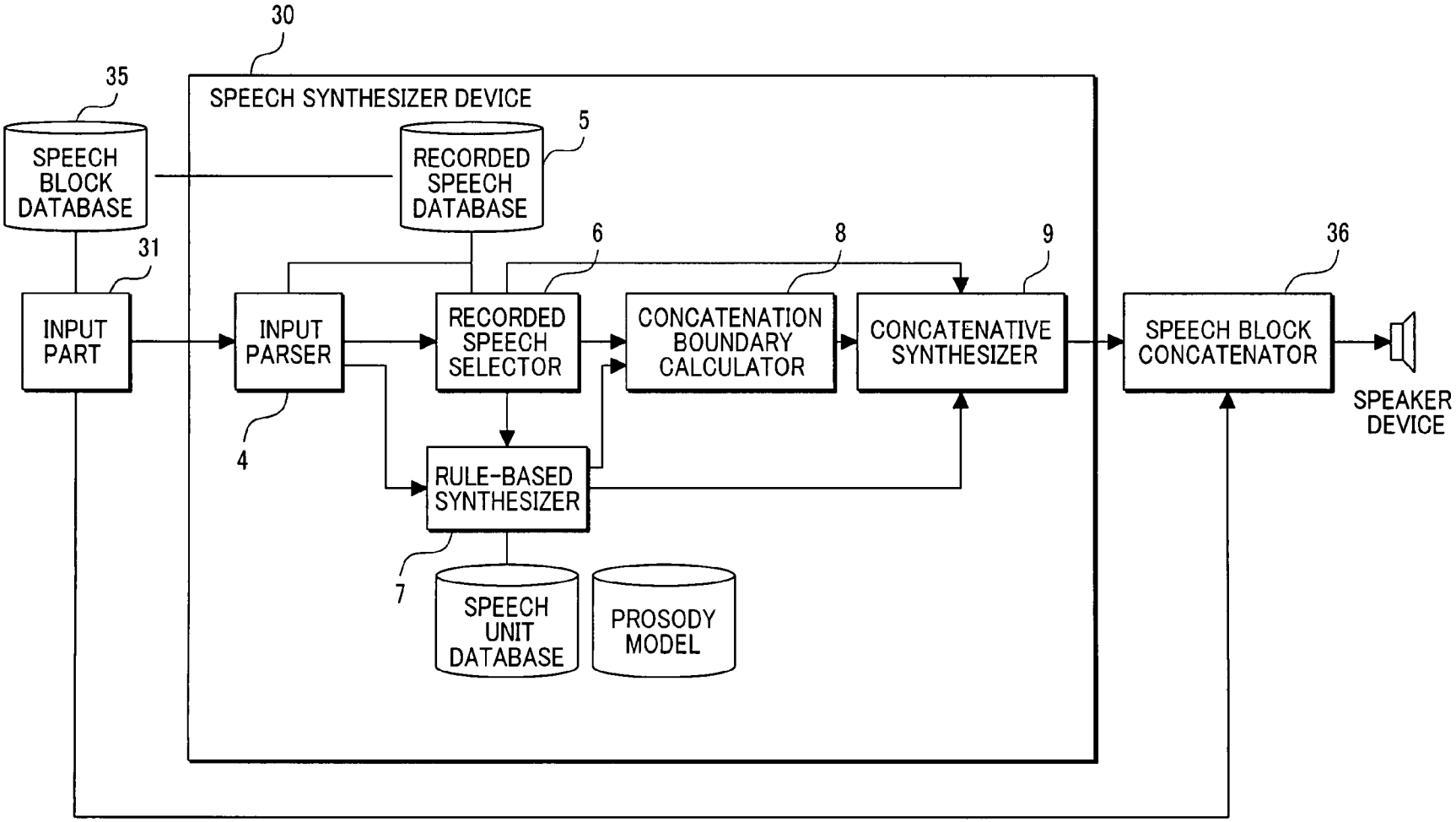
FIG. 9 is a block diagram showing the construction of the speech synthesizer in a third embodiment of the present invention.
Figure 10:
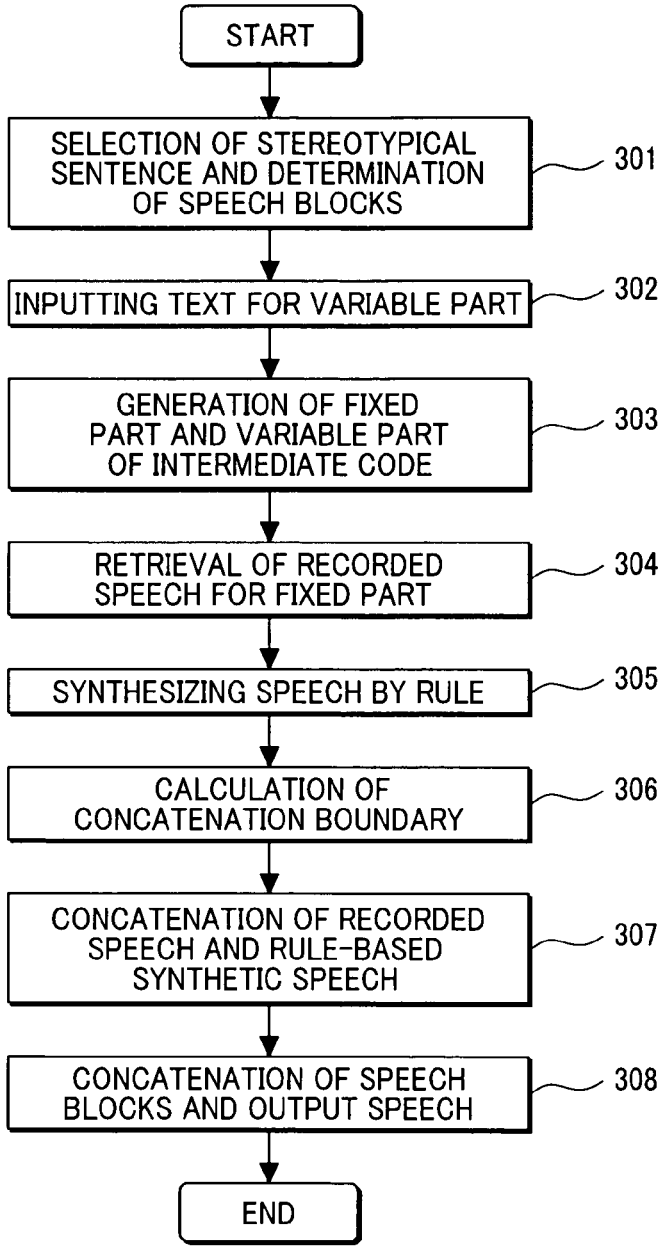
FIG. 10 is a flowchart showing the operation of the speech synthesizer in the third embodiment.

FIG. 9 relates to a third embodiment of the present invention, and is a block diagram showing the construction of a railroad broadcasting system to which the present invention is applied. FIG. 10 is a flowchart showing the operation of a speech synthesizer 30 of the second embodiment.

In this embodiment, a device that concatenates speech blocks previously recorded to create synthetic speech has a function to generate a speech block including a variable part by implementing the present invention.

Figure 11:
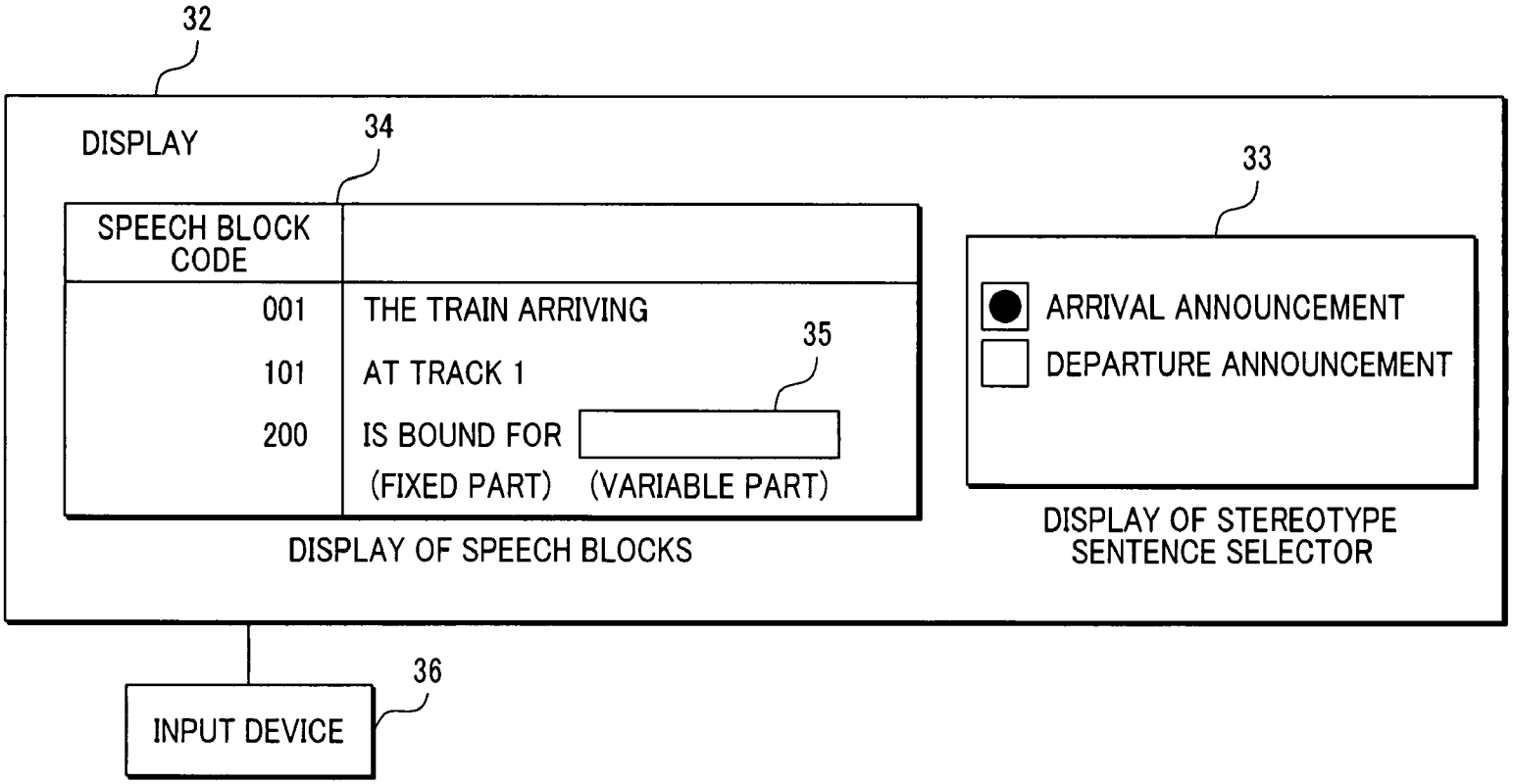
FIG. 11 is a drawing showing the construction of an input screen in the third embodiment.

An input part 31, as shown in FIG. 11, includes; an input screen 32 having: a display means 33 that selects stereotypical sentences; a display means 34 that displays the order structure of speech blocks corresponding to a selected stereotypical sentence; and a display means 35 that displays a speech block including a variable part so that a fixed part and a variable part of text are distinguishable from each other; and an input device 36 that allows a user to select a stereotypical sentence to be outputted from plural stereotypical sentences while viewing the input screen 32, edit the order of speech blocks, and input text of a variable part by a keyboard or the like.

Figure 12:
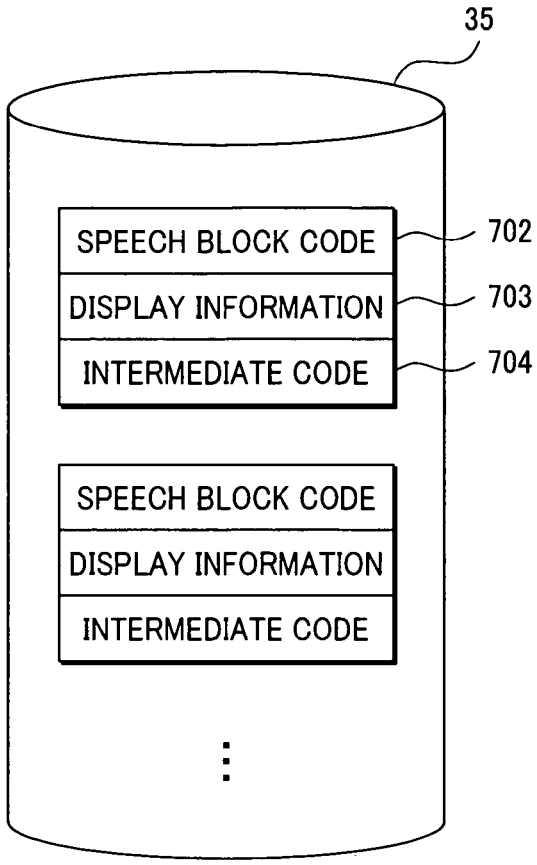
FIG. 12 is a drawing showing information stored in a speech block information storage unit in the third embodiment.

A speech block information database 35, which has a structure as shown in FIG. 12, is constructed so that speech data previously recorded in the recorded speech database 5 is classified as shown by an example of FIG. 13, and stereotypical sentences can be represented by combinations of speech block class codes 701. Moreover, the speech block information database 35, as shown in FIG. 13, stores speech block codes 702 uniquely provided for each recorded speech data. In this case, the recorded speech data is structured so that speech block class code 701 can be identified from speech block code 702. As an example, in FIG. 13, the recorded speech data is structured so that the highest order column of speech block code 702 matches the highest order column of speech block class code 701.

Hereinafter, the operation of the third embodiment will be described.

The input part 31 determines the structure of speech blocks by selecting a stereotypical sentence (Step 301). In the order structure of speech blocks, when speech block code is specified, fixed speech blocks are used, and when speech block class code is specified, corresponding speech blocks can be generated by a speech synthesizing method of the present invention. For example, speech block information shown in the example of FIG. 13 is stored, and when speech block class code "200" is set in the input part, on the input screen, an area for inputting text of a variable part, and "is bound for" of a fixed part as display data 703 are displayed.

Next, the input part inputs text of the variable part from a keyboard, and determines the text of the variable part (Step 302). For example, when "Harajuku" is inputted as text of the variable part, "ha/ra/ju/ku/yu/ki/ga/ma/i/ri/ma/s" is generated as a speech block, in combination with the fixed part.

The input parser 4, to create a speech block including the variable part specified in the input part 31, retrieves intermediate code 704 of a fixed part corresponding to speech block class code 701. It converts the text of the variable part obtained from the input part into intermediate code by linguistic analysis, and determines the intermediate code of the variable part (Step 303). By this step, when the text of the variable part is "Harajuku" intermediate code "ha/ra/ju/ku" of the variable part is obtained.

Next, the recorded speech selector 6, according to the input of the variable part, selects an appropriate recorded speech from among plural recorded speeches having the same fixed part. It compares the intermediate code including the fixed part and the variable part with intermediate codes corresponding to recorded speech, and selects recorded speech having the longest matching intermediate code (Step 304). By doing so, a concatenation boundary position of the recorded speech and the rule-based synthetic speech is determined not only in the fixed part but also may, in some cases, be determined in the variable part, so that synthetic speech of higher quality can be created.

Next, the rule-based synthesizer 7 uses the intermediate code of the variable part and the intermediate code of the fixed part that are obtained in the input parser 4 to determine the range of creating rule-based synthetic speech (Step 305). When the range of creating rule-based synthetic speech is defined as one speech block including a variable part, rule-based synthetic speech including a fixed part "yu/ki/ga/ma/i/ri/ma/s" in addition to the variable part "ha/ra/ju/ku" is created.

Next, the concatenation boundary calculator 8 uses the acoustic characteristics of the recorded speech and the acoustic characteristics of the rule-based synthetic speech to calculate a concatenation boundary position in an overlap region between recorded speech data and rule-based synthetic speech data (Step 306).

Figure 14:
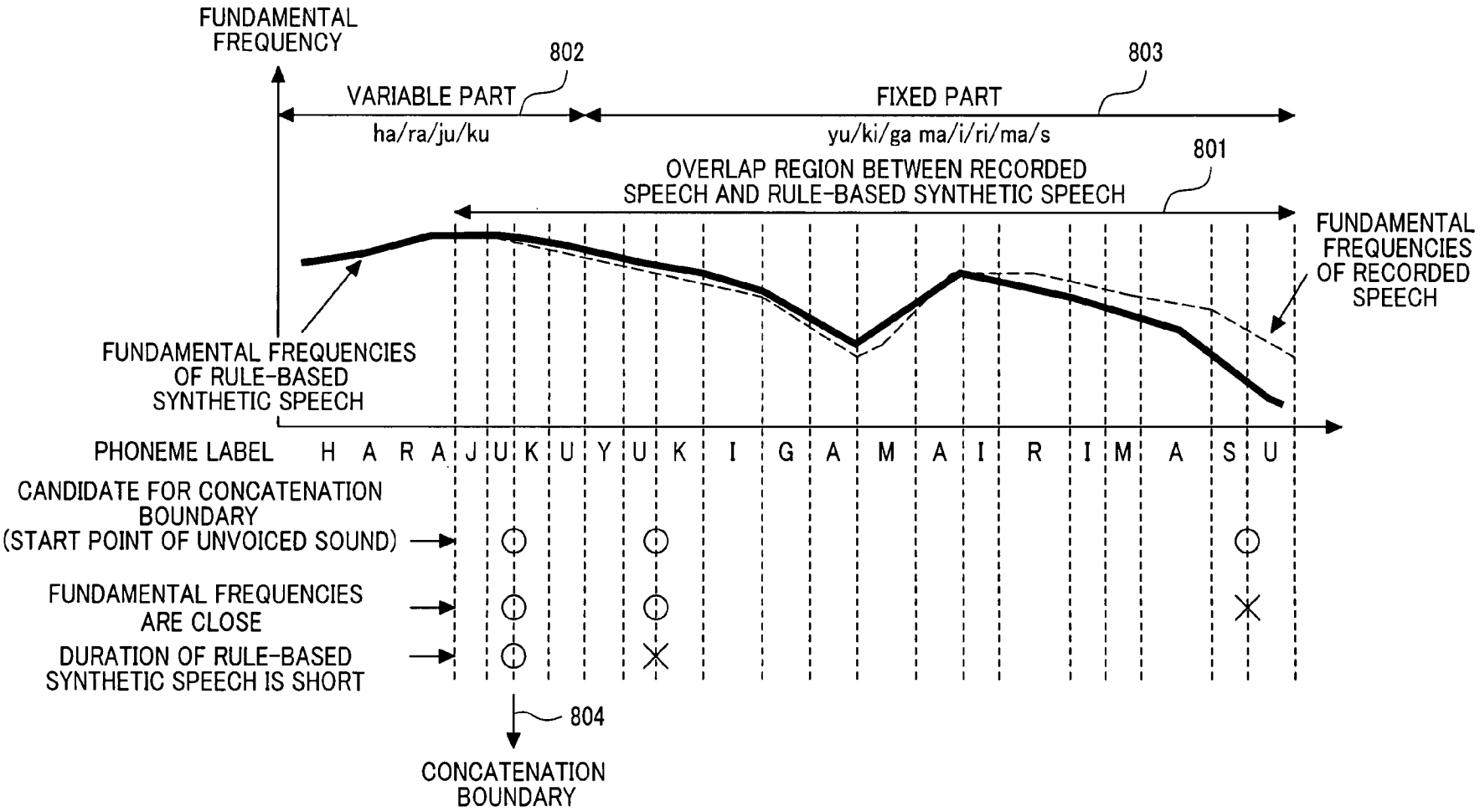
FIG. 14 is a drawing for explaining a method of selecting a concatenation boundary position in the third embodiment.

The Step 306 is the same as Step 106 of the first embodiment. A concatenation boundary position of the recorded speech and the rule-based synthetic speech is determined not only in the fixed part but also may, in some cases, be determined in the variable part. FIG. 14 shows an example that a concatenation boundary position is determined in a variable part. Recorded speeches corresponding to speech block information as shown in FIG. 13 are stored in the recorded speech database 5, and when speech block class code "200" is specified as a fixed part, recorded speeches of speech block codes "201," "202," and "203" become targets of selection. In a case where intermediate code of a variable part is "ha/ra/ju/ku," when intermediate code "ha/ra/ju/ku/yu/ki/ga/ma/i/ri/ma/s" combined with the fixed part is compared with intermediate code of each recorded speech, "shi/N/ju/ku/yu/ki/ga/ma/i/ri/ma/s" of speech block code is is selected.

By doing so, an overlap region 801 between recorded speech and rule-based synthetic speech becomes a region corresponding to "ju/ku/yu/ki/ga/ma/i/ri/ma/s," so that recorded speech can be used for a part of "ju/ku" being a part of a variable part 802, as well as a fixed part 803 previously specified, and a concatenation boundary position 804 can be determined in the variable part 802.

Next, the concatenative synthesizer 9 uses the concatenation boundary position obtained from the concatenation boundary calculator 8 to cut off the recorded speech data and the rule-based synthetic speech data, and by concatenating the recorded speech data and rule-based synthetic speech data that are cut off, generates synthetic speech data corresponding to speech blocks including a variable part (Step 307). The concatenation boundary position is calculated as time in the recorded speech data and time in the rule-based synthetic speech data, and speech data is cut off and concatenated using the calculated times. Although this step is the same as Step 107 of the first embodiment, the speech data is outputted from a loudspeaker by the next speech block concatenator 36.

The speech block concatenator 36 concatenates the speech blocks, based on the order of the speech blocks obtained from the input part, and generates output speech (Step 308). For speech blocks including a variable part, synthetic speech obtained from the concatenative synthesizer is used.

In this way, in a device that concatenate recorded speech blocks to create synthetic speech, synthetic speech of natural concatenation can be outputted by using speech blocks that use rule-based synthetic speech.

As described above, in the third embodiment, when the present invention is applied to a railroad broadcasting system, a device that concatenates speech blocks previously recorded to create synthetic speech has a function to generate speech blocks including a variable part, and can output speech of high quality.

As detailed above, according to the present invention, based on acoustic characteristics of an overlap region between recorded speech data previously stored, and speech data generated by rule-based synthesis, concatenation boundary is selected taking the continuity of timbres and prosodies between recorded speech and rule-based synthetic speech into account, so that natural synthetic speech can be created. Moreover, since a rule-based synthesizer creates rule-based synthetic speech, based on the acoustic characteristics of the overlap region, the timbre and prosody of the rule-based synthetic speech close to those of recorded speech, and natural synthetic speech can be created.

Although the present invention is suitably applied to an on-vehicle car navigation system and a railroad broadcasting system, it is also applicable to speech guidance systems that output text in voice.

What is claimed is:

1. A speech synthesizer that synthesizes text including a fixed part and a variable part, comprising:

a recorded speech database that previously stores recorded speech data including the recorded fixed part;

a rule-based synthesizer that generates rule-based synthetic speech data including the variable part and at least part of the fixed part from the received text;

a concatenation boundary calculator that calculates a concatenation boundary position in a region in which the recorded speech data and the rule-based synthetic speech data overlap, based on acoustic characteristics of the recorded speech data and the rule-based synthetic speech data that correspond to the text; and a concatenative synthesizer that concatenates the recorded speech data and the rule-based synthetic speech data that are segmented in the concatenation boundary position, to generate synthetic speech data corresponding to the text.

2. The speech synthesizer according to claim 1, wherein the concatenative synthesizer uses acoustic characteristics of the recorded speech data in a region in which the recorded speech data and the rule-based synthetic speech data that correspond to the text overlap, to generate the rule-based synthetic speech data matching the recorded speech data.

3. The speech synthesizer according to claim 1, wherein the rule-based synthesizer processes the rule-based synthetic speech data, based on the acoustic characteristics of the recorded speech data and the rule-based synthetic speech data in the position of a concatenation boundary obtained from the concatenation boundary calculator.

4. The speech synthesizer according to any one of claim 1, wherein as the acoustic characteristics, at least one of phoneme class, fundamental frequency, phonemic duration, power, and spectrum is used.

5. The speech synthesizer according to claim 1, wherein the rule-based synthesizer generates the second speech data in any unit of the whole of the fixed part, one breath group, and one sentence, of the variable part and the fixed part preceding or following the variable part.

6. The speech synthesizer according to claim 1, wherein the concatenation boundary calculator makes selection from among plural phoneme boundaries contained in an overlap region between the recorded speech data and the rule-based synthetic speech data.

7. The speech synthesizer according to claim 1, wherein the recorded speech database stores speech data previously recorded in the unit of one breath group or one sentence that includes the fixed part and at least part of other than the fixed part, as the recorded speech data.

8. The speech synthesizer according to claim 1, wherein the concatenation boundary position is calculated as time in the recorded speech data and time in the rule-based synthetic speech data, and the speech data is cut off and concatenated using the calculated times.

9. The speech synthesizer according to claim 1, wherein a means that outputs the synthetic speech data generated by the concatenative synthesizer is provided.

10. A speech synthesizer that synthesizes text including a fixed part and a variable part, comprising:

a recorded speech database that previously stores recorded speech data including the recorded fixed part;

a rule-based synthetic parameter calculator that calculates rule-based synthetic parameters including the variable part and at least part of the fixed part from the received text to generate acoustic characteristics of rule-based synthetic speech;

a concatenation boundary calculator that calculates a concatenation boundary position in a region in which the recorded speech data and the rule-based synthetic speech data overlap, using acoustic characteristics of the recorded speech data and acoustic characteristics of the rule-based synthetic speech data;

a rule-based synthetic speech data part that generates rule-based synthetic speech data by using acoustic characteristics of the recorded speech, acoustic characteristics of the rule-based synthetic speech, and the concatenation boundary position;

a concatenative synthesizer that concatenates the recorded speech data and the rule-based synthetic speech data that are segmented in the concatenation boundary position, to generate synthetic speech data corresponding to the text; and a means that outputs the synthetic speech data.

11. A speech synthesizer that creates synthetic speech by concatenating a speech block including a variable part and a speech block including a fixed part, previously recorded, comprising:

a recorded speech database that stores speech data including the speech blocks previously recorded;

an input parser that generates intermediate code of a speech block of the variable part, and intermediate code of a speech block of the fixed part, from received input text;

a recorded speech selector that selects appropriate recorded speech data from among plural recorded speech data having the same fixed part according to the input of the variable part;

a rule-based synthesizer that uses intermediate code of a speech block of the variable part obtained by the input parser, and intermediate code of a speech block of the fixed part that are obtained in the input parser to determine the range of generating rule-based synthetic speech data;

a concatenation boundary calculator that calculates a concatenation boundary position in a region in which the recorded speech data and the rule-based synthetic speech data overlap, using acoustic characteristics of the recorded speech data and acoustic characteristics of the rule-based synthetic speech data;

a concatenative synthesizer that uses the concatenation boundary position obtained from the concatenation boundary calculator to cut off the recorded speech data and the rule-based synthetic speech data, and generates synthetic speech data corresponding to a speech block including the variable part by concatenating the recorded speech data and the rule-based synthetic speech data that are cut off; and a speech block concatenator that concatenates speech blocks, based on the order of speech blocks obtained from the input text, and creates output speech.

12. A speech synthesizing method comprising:

a first step of previously storing recorded speech data and first intermediate code corresponding to the recorded speech data to prepare for input text;

a second step of converting the input text into second intermediate code;

a third step of referring to the first intermediate code to distinguish the second intermediate code into a fixed part corresponding to the first intermediate code and a variable part not corresponding to it;

a fourth step of acquiring a part of the first intermediate code that corresponds to the fixed part, from the recorded speech data;

a fifth step of using the second intermediate code to generate rule-based synthetic speech data of the whole of a part corresponding to the variable part and at least part of a part corresponding to the fixed part; and a sixth step of concatenating the acquired part of the recorded speech data and part of the generated rule-based synthetic speech data.

* * * * *